US005873140A

United States Patent [19]

Holloway

[11] Patent Number: 5,873,140

[45] Date of Patent: Feb. 23, 1999

[54] TOOTHBRUSH CRIMPED CONTOUR FILAMENT

[75] Inventor: Ralph William Holloway, Knowsley, England

[73] Assignee: Ralph Holloway, Knowsley, England

[21] Appl. No.: 21,116

[22] Filed: Feb. 10, 1998

[30] Foreign Application Priority Data

Feb. 22, 1997 [GB] United Kingdom ..... 2063495

[51] Int. Cl.[6] ..... A46B 9/04

[52] U.S. Cl. ..... 15/167.2; 15/167.1; 15/DIG. 5; D4/104

[58] Field of Search ..... 15/167.1, 167.2, 15/DIG. 5; D4/104

[56] References Cited

U.S. PATENT DOCUMENTS

| | | | |
|---|---|---|---|
| 3,100,309 | 8/1963 | Gambino | 15/167.1 |
| 4,382,309 | 5/1983 | Collis | 15/167.2 |
| 4,493,125 | 1/1985 | Collis | 15/167.2 |
| 5,027,463 | 7/1991 | Daub | 15/167.2 X |
| 5,148,567 | 9/1992 | Daub | 15/167.2 X |

FOREIGN PATENT DOCUMENTS

| | | | |
|---|---|---|---|
| 2614189 | 10/1988 | France | 15/167.1 |

*Primary Examiner*—Mark Spisich

[57] ABSTRACT

A toothbrush for simultaneously brushing a plurality of tooth surfaces, outer inner and crown portions comprising a one head construction with anchored filaments arranged in bundles of bristles forming four longitudinal rows, the exterior angled facing inwards the two interior rows upright. By not being encircled by exterior filaments the top brushing surface remains concave.

1 Claim, 1 Drawing Sheet

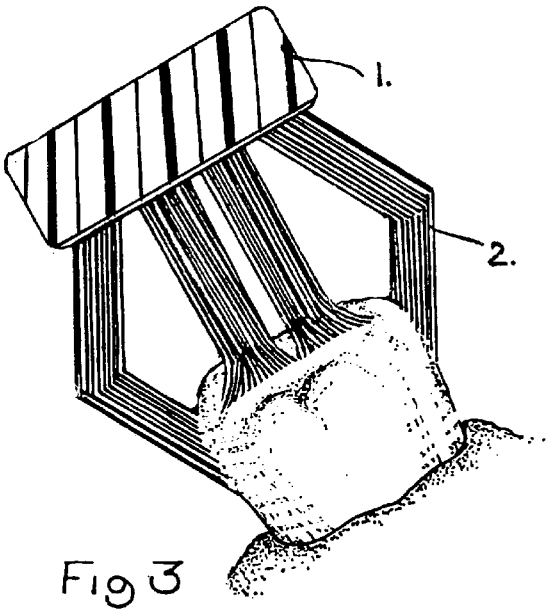
Fig 3
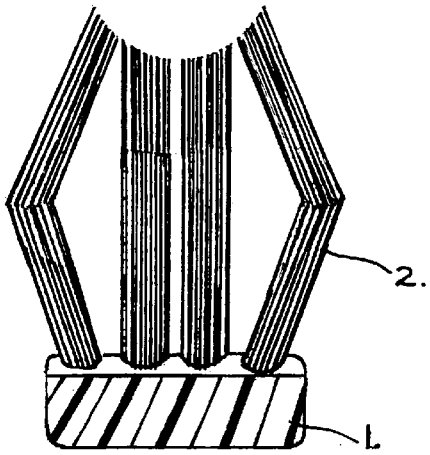
Fig 4
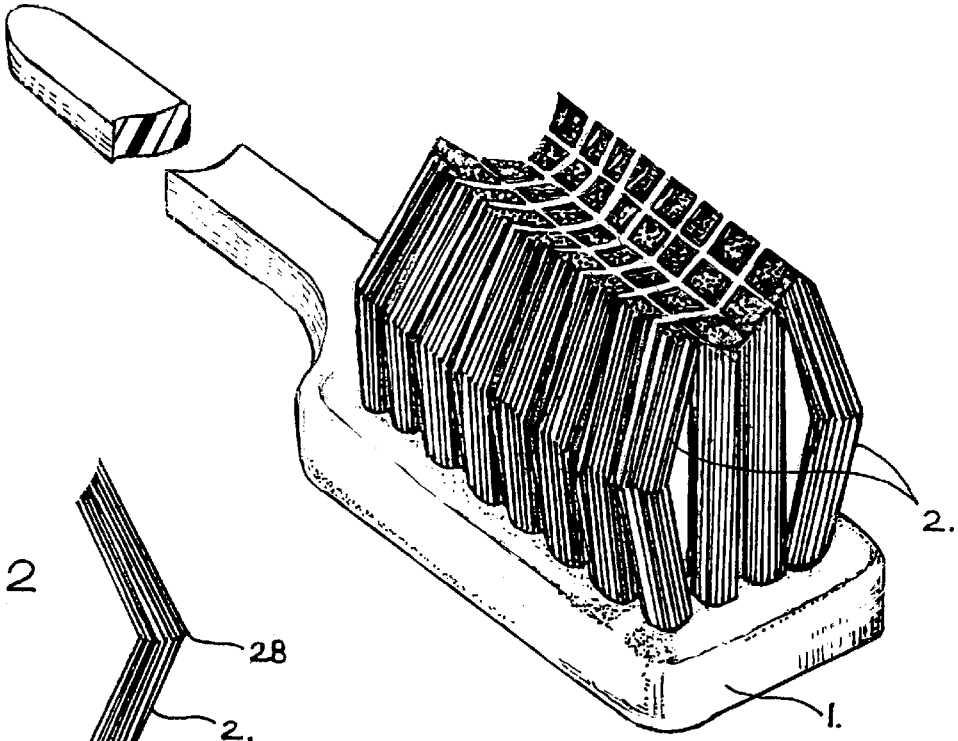
Fig 1
Fig 2
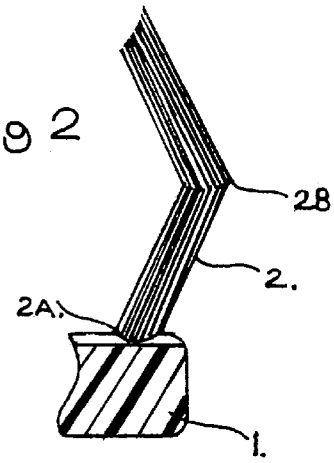

TOOTHBRUSH CRIMPED CONTOUR FILAMENT

BACKGROUND OF THE INVENTION

Dentistry being more advanced than in years past emphasis is placed upon removing the possible build up of plaque and tartar deposits from the gum line. This directive leads to a change in brushing techniques, consequently a toothbrush adapted to overcome this problem would assist in dental hygiene.

This Invention relates to the design for a toothbrush capable of cleaning outside and inside to gum line and crown portions of teeth simultaneously U.S. Pat. No. 4,493,125 to Collis, and U.S. Pat. No. 5,148,567, to Daub, both disclosed a toothbrush design in a endeavour to have all. these qualities incorporated- The embodiments of both Collis and Daub compared to the cleaning efficiency of a conventional toothbrush is that the capability to clean the front enamel of teeth becomes secondary and almost ineffective with having exterior bristles encompassing the brush surface.

Previous toothbrush designs of a curved bristle embodiment rely upon the principle of the filament anchored upon the toothbrush head, the curvature and the composition of the bristle to determine the brushing pressure, with these designs strength and flexibility of the brushing action would lend it self ineffective and subject to the said perimeter filaments splaying.

The above mentioned filament designs represent the example of a "Curved Finger" anchored at the knuckle the length extending to the nail.

It is the object of this Invention to provide a principle advantage with the distinctive outer filament embodiment providing a secondary 'anchorage' employed as in evident in the joint between the knuckle and nail in a curved finger and missing in the previous examples cited- Thus the strength inherent with "Corrugation" is brought into play.

BRIEF SUMMARY OF THE INVENTION

The object of this Invention is to provide a toothbrush consisting of a one head construction effective in the cleaning of outside, inside and crown portions of teeth surfaces simultaneously It is the object of this Invention to present a new and improved toothbrush which radical in purpose does not detract from the public acceptance of the conventional one head toothbrush presently in use, the practical appearance being important.

It is the object of this Invention to provide a toothbrush effective in cleaning outside, and inside of teeth surfaces with equal importance represented in the embodiment to the cleaning of crown portions the basic brushing principle not being neglected.

BRIEF DESCRIPTION OF THE SEVERAL VIEWS OF THE DRAWING

In the drawings wherein like reference numberals represent like parts.

FIG. 1. is a perspective view of an embodiment of a toothbrush constructed to the design of this Invention FIG. 2. is an enlarged sectional view of the perimeter bristle filament of the toothbrush of FIG. 1 (2)

FIG. 3. is an end vertical sectional view showing the toothbrush of FIG. 1. in a cleaning position around a tooth.

FIG. 4 is a frontal view of the toothbrush of FIG. 1. showing the bristle arrangement on the bristle mounting heal.

DETAILED DESCRIPTION OF THE INVENTION

Refering to the drawings, more specifically to FIGS. 1 to 4. FIG. 1. is the embodiment of my novel, manual one head toothbrush. The reference numberals represent like parts. The toothbrush comprises a head 1. to which four rows of bristles are anchored, each individual bristle composed of filaments of which upon pressure to the surface of said bristles the tooth contour is encompassed as in FIG. 3.

In the embodiment shown FIG. 2 the crimped design of the exterior filament 2. being anchored 2A to the brushead 1. a secondary anchorage 2B. becomes introduced.

In the embodiment shown FIG. 4 the concave filament bristle surface illustrates the combined cleaning capabilities of angled bristles which do not neglect the basic brushing technique currently in use as they add to the surface area.

What I claim as my invention is:

1. A toothbrush comprising:

(a)an elongated brush head having a bristle mounting surface; and (b)four rows of bristles secured on said bristle mounting surface and extending along the length of the brush head, said four rows of bristles being comprised of:

two central rows of straight bristles and two peripheral rows of bristles, the peripheral rows of bristles being located on respective opposite sides of the two central rows, each of the bristles of the peripheral rows having a first straight portion extending from and defining an acute angle with respect to the bristle mounting surface and extending in a direction away from the two central rows and a second straight portion at an angle with respect to the first straight portion and wherein the second straight portion extends from the first straight portion in a direction toward the two central rows, wherein the free ends of the bristles of each of the four rows define a substantially continuous concave brushing surface extending along the brush head and enabling the simultaneous cleaning of both the biting surface of the teeth as well as the gum line.

* * * * *